US006880868B2

(12) United States Patent
Brami et al.

(10) Patent No.: US 6,880,868 B2
(45) Date of Patent: Apr. 19, 2005

(54) ELECTROMAGNETIC LOCK

(75) Inventors: Daniel Salomon Brami, Boulogue Billancourt (FR); Isaac El Mechali, Pantin (FR); Jean Michel Defert, Sannois (FR)

(73) Assignee: Digit Societe a Responsibilite Limitee, Pantin (FR)

( * ) Notice: Subject to any disclaimer, the term of this patent is extended or adjusted under 35 U.S.C. 154(b) by 0 days.

(21) Appl. No.: 10/239,197

(22) PCT Filed: Feb. 13, 2001

(86) PCT No.: PCT/FR01/00404

§ 371 (c)(1),
(2), (4) Date: Sep. 27, 2002

(87) PCT Pub. No.: WO01/75257

PCT Pub. Date: Oct. 11, 2001

(65) Prior Publication Data

US 2003/0057715 A1 Mar. 27, 2003

(30) Foreign Application Priority Data

Mar. 30, 2000 (FR) ..... 00 04004

(51) Int. Cl.[7] ..... E05C 19/16
(52) U.S. Cl. ..... 292/251.5; 292/DIG. 55
(58) Field of Search ..... 292/251.5, 144, 292/DIG. 55, DIG. 61

(56) References Cited

U.S. PATENT DOCUMENTS 4,487,439 A * 12/1984 McFadden ..... 292/251.5
4,826,223 A * 5/1989 Geringer et al. ..... 292/251.5
4,840,411 A 6/1989 Sowersby
4,861,080 A * 8/1989 Frolov ..... 292/251.5
4,957,316 A * 9/1990 Frolov ..... 292/251.5
4,981,312 A * 1/1991 Frolov ..... 292/251.5
4,986,581 A * 1/1991 Geringer et al. ..... 292/251.5
5,000,497 A * 3/1991 Geringer et al. ..... 292/251.5
5,006,723 A * 4/1991 Geringer et al. ..... 292/251.5
5,016,929 A 5/1991 Frolov
5,033,779 A * 7/1991 Geringer et al. ..... 292/251.5
5,141,271 A * 8/1992 Geringer et al. ..... 292/251.5
5,184,855 A * 2/1993 Waltz et al. ..... 292/251.5
5,184,856 A * 2/1993 Waltz ..... 292/251.5
RE35,146 E 1/1996 Frolov
5,611,582 A * 3/1997 Frolov et al. ..... 292/251.5
5,897,149 A * 4/1999 Frolov ..... 292/251.5
6,007,119 A 12/1999 Roth et al.
6,053,546 A * 4/2000 Frolov ..... 292/251.5
6,135,515 A 10/2000 Roth et al.
6,260,892 B1 * 7/2001 Chang ..... 292/251.5

FOREIGN PATENT DOCUMENTS

GB 2263137 7/1993
WO 9918315 4/1999

* cited by examiner

*Primary Examiner*—J J Swan
*Assistant Examiner*—Thomas Ho
(74) *Attorney, Agent, or Firm*—Greenblum & Bernstein, P.L.C.

(57) ABSTRACT

The invention concerns an electromagnetic lock comprising two parts, one of which comprises an electromagnet and the other a mobile armature capable of moving to counter the return springs when the electromagnet is energized. One of the parts has at least one protuberance extending from one edge of the corresponding part to the proximity of the other edge, the protuberance sized and positioned to be capable of penetrating into a housing of the other part when the parts coincide and the electromagnet is energized, the height of the protuberance being less than the distance normally separating the two parts when the electromagnet is not energized. This abstract is neither intended to define the invention disclosed in this specification nor intended to limit the scope of the invention in any way.

27 Claims, 3 Drawing Sheets

ELECTROMAGNETIC LOCK

CROSS REFERENCE TO RELATED APPLICATIONS

The present application is a National Stage Application of International Application No. PCT/FR01/00404 filed Feb. 13, 2001. Further, the present invention claims priority under 35 U.S.C. § 119 of French Patent Application No. 00/04004 filed Mar. 30, 2000.--

BACKGROUND OF THE INVENTION

1. Field of the Invention

The present invention relates to an electromagnetic lock. Such a lock comprises two parts, one of which is fixed while the other is affixed to the element for which one would like to control the closing, such as a door.

2. Discussion of Background Information

The fixed part of the lock consists of an electromagnet and the other part of a metal armature capable of being displaced to counter a return spring. When the armature is facing the electromagnet and the latter is energized, said armature is attracted and it is not possible to control the door as the force needed for pulling the armature away is much greater than the force that could be provided by an average user.

Currently, electromagnetic locks are arranged such that their active surfaces are parallel to the plane of the opening to be controlled. As a result, the necessary force to be applied in order to allow the sliding of the armature in such plane with respect to the electromagnet is minimized. However, the electromagnetic force used to maintain closure is typically far less than the force able to be applied by a user when pulling in such plane.

It is possible to overcome this drawback by increasing the force of the electromagnet, but such an increase translates into an unacceptable increase of the volume of said electromagnet and its cost.

An adequate solution to avoid oversizing the electromagnet consists of providing, on one of the parts of the lock, a protuberance capable of penetrating into a housing or aperture of the other part and of maintaining itself therein as long as the electromagnet is energized.

Such a lock is described, among others, in the document WO 99/18315 and comprises a mobile armature having two truncated, diagonally opposed, protuberances capable of penetrating into corresponding housings of the electromagnet when the armature is facing the electromagnet. Since the height of the aforementioned protuberances is greater than the distance that normally separates the electromagnet and the armature, the armature must be floatingly mounted on its base, which involves the use of two series of opposing springs that keep the armature balanced. This adds unnecessary expense to such a lock because of the use of two springs. Furthermore, the adjustment of the two springs is difficult.

SUMMARY OF THE INVENTION

The lock according to the present invention overcomes these drawbacks by the use of a common armature, which lock, in one embodiment, also comprises a return spring that keeps an armature and an electromagnet spaced apart when the electromagnet is not energized, and thereby maintains the armature in a retracted position. Either one of the elements of the lock has at least one linear protuberance extending parallel to the direction of displacement of the mobile part, which protuberance is capable of penetrating into a corresponding housing provided on the other part when the two parts coincide, and the height of the protuberance is less than the distance separating the armature and electromagnet when the electromagnet is not energized.

The electromagnetic lock comprises an electromagnet, a mobile armature and a return mechanism, wherein the return mechanism and the mobile armature are positioned to permit displacement of the mobile armature in a direction counter to the direction of force of the return mechanism. The armature and return mechanism are operationally in communication to define a retracted position of the armature to permit opening of the lock when the electromagnet is not energized. At least one of the electromagnet or the mobile armature has at least one surface which, when the electromagnet is energized, forms a first and second opposing surface. The first opposing surface has a protuberance and the second opposing surface defines an open chamber for closely receiving the protuberance; they are positioned to bring the opposing surfaces into contiguous proximity with each other when the protuberance is received in the chamber. The protuberance has a height less than the distance normally separating the opposing surfaces when the electromagnet is not energized. In a first embodiment of the invention, the return mechanism comprises a spring.

The return mechanism is calibrated such that the force that tends to displace the armature is greater than the force of the spring only when the opposing surface of the armature facing the opposing surface of the electromagnet exceeds a certain value.

In a second embodiment, at least one of the electromagnet or the mobile armature has at least a second protuberance and at least a second open chamber for closely receiving the second protuberance when the first protuberance is received in the first chamber.

Preferably, each opposing surface has an edge wherein the protuberance is a transverse rod which extends from one edge to the proximity of the other edge and aligns with corresponding chambers when the opposing surfaces are in contiguous alignment and the electromagnet is energized.

According to another aspect of the invention, an electromagnetic lock comprises an electromagnet, a mobile armature and a return spring, wherein the return spring and the mobile armature are positioned to permit displacement of the mobile armature in a direction counter to the direction of force of the return spring. The armature and return spring are operationally in communication to define a retracted position of the armature to permit opening of the lock when the electromagnet is not energized, and the return spring is calibrated such that the force that tends to displace the armature is greater than the force of the spring only when the opposing surface of the armature facing the opposing surface of the electromagnet exceeds a certain value. Furthermore, at least one of the electromagnet or the mobile armature has at least one surface which, when the electromagnet is energized, forms a first and second opposing surface and the first opposing surface has a protuberance and the second opposing surface defines an open chamber for closely receiving the protuberance which are positioned to bring the opposing surfaces into contiguous proximity with each other when the protuberance is received in the chamber. The protuberance has a height which is less than the distance normally separating the opposing surfaces when the electromagnet is not energized. The electromagnet or mobile armature may have a second protuberance and a second open chamber for closely receiving the second protuberance when the first protuberance is received in the first chamber. The lock may further have opposing surfaces each having an edge, and the protuberance extends from one edge to the proximity of the other edge when the opposing surfaces are in contiguous alignment and the electromagnet is energized.

According to the invention, a method of modifying an electromagnetic lock comprises providing an electromagnetic lock, having an electromagnet and a mobile armature and a return mechanism, and positioning the return mechanism and the mobile armature in a manner to permit displacement of the mobile armature in a direction counter to the direction of force of the return mechanism and operationally in communication to define a retracted position of the armature to permit opening of the lock when the electromagnet is not energized, and forming a first and second opposing surface on at least one of the electromagnet or the mobile armature when the electromagnet is energized. The method further comprises providing a protuberance on the first opposing surface and defining an open chamber on the second opposing surface for closely receiving the protuberance. The method further comprises positioning the protuberance and chamber to permit the opposing surfaces to be in contiguous proximity with each other when the protuberance is received in the chamber when the electromagnet is energized. The return mechanism may be calibrated so that the force which the return mechanism provides to displace the armature into a retracted position is greater than the force of the mobile armature only when the opposing surface of the armature facing the opposing surface of the electromagnet exceeds a certain value.

BRIEF DESCRIPTION OF THE DRAWINGS

The present invention will be better understood from the following description, with reference to the attached drawings given only by way of example, and in which.

DETAILED DESCRIPTION OF THE INVENTION

Figure 1:
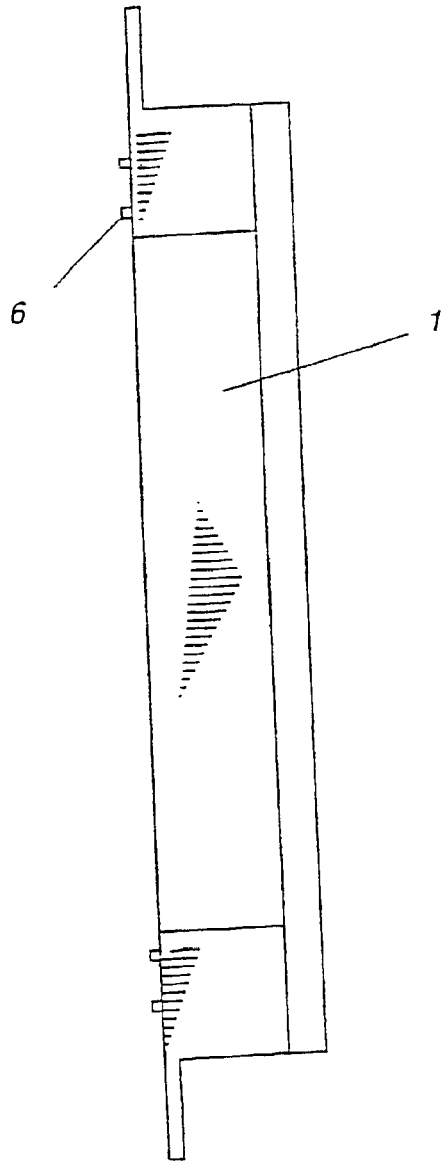
FIG. 1 is a front view of one of the parts of the lock.
Figure 2:
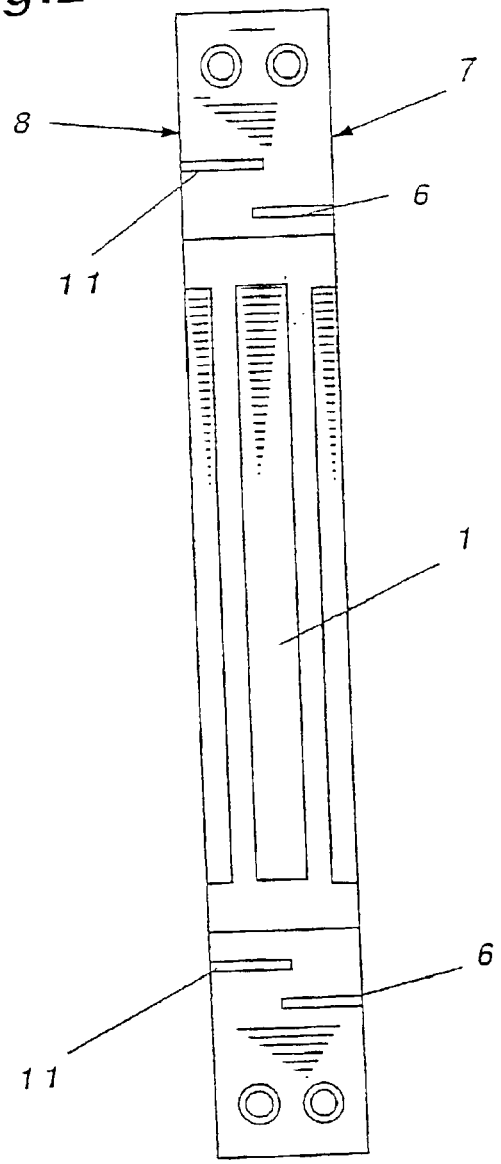
FIG. 2 is the left view of FIG. 1.
Figure 3:
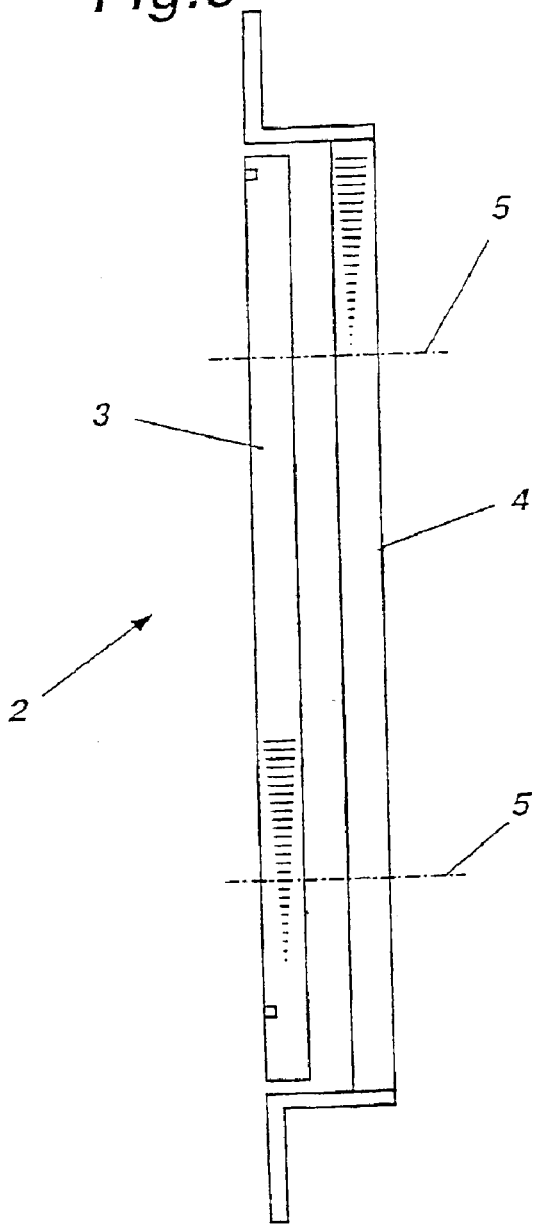
FIG. 3 is a front view of the other part of the lock.
Figure 4:
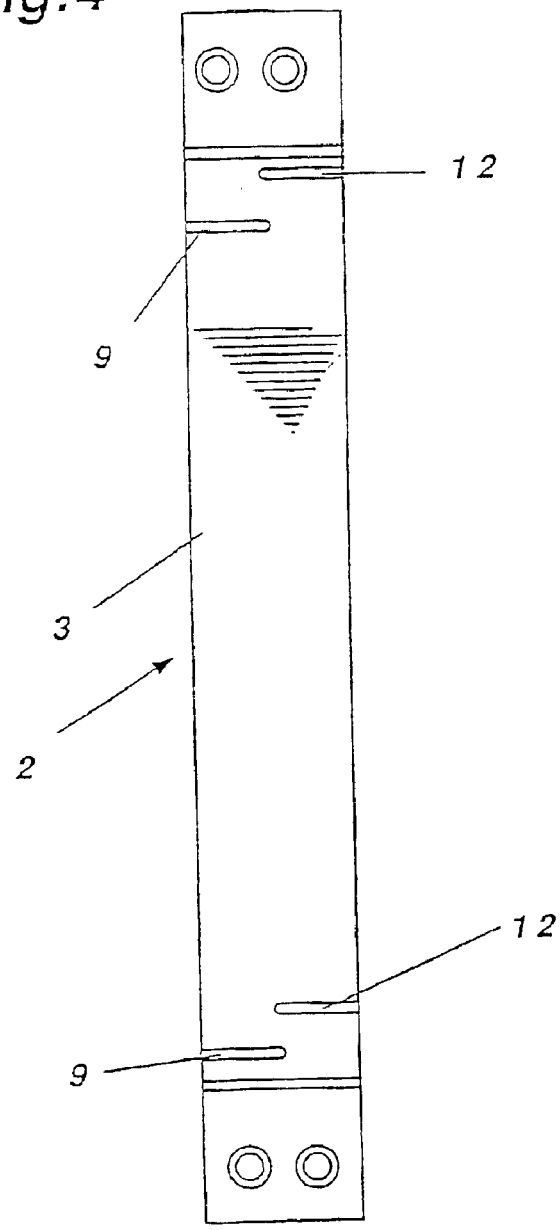
FIG. 4 is the left view of FIG. 3.

In referring to the drawings, one can see that the lock is composed of two parts 1 and 2, the part 1 comprising the electromagnet and the part 2 comprising the mobile armature 3 which is normally returned to the stationary base 4 by means of two identical springs whose axes are shown by the reference number 5 in FIG. 3.

According to one embodiment of the invention, the part 1 has at least one protuberance 6 that is in the form of a rod extending transversely to part 1 and along a direction parallel to the direction of displacement of the other part, when part 1 is considered as being stationary. The protuberance 6 must extend parallel to the plane containing the direction of displacement.

Figure 5:
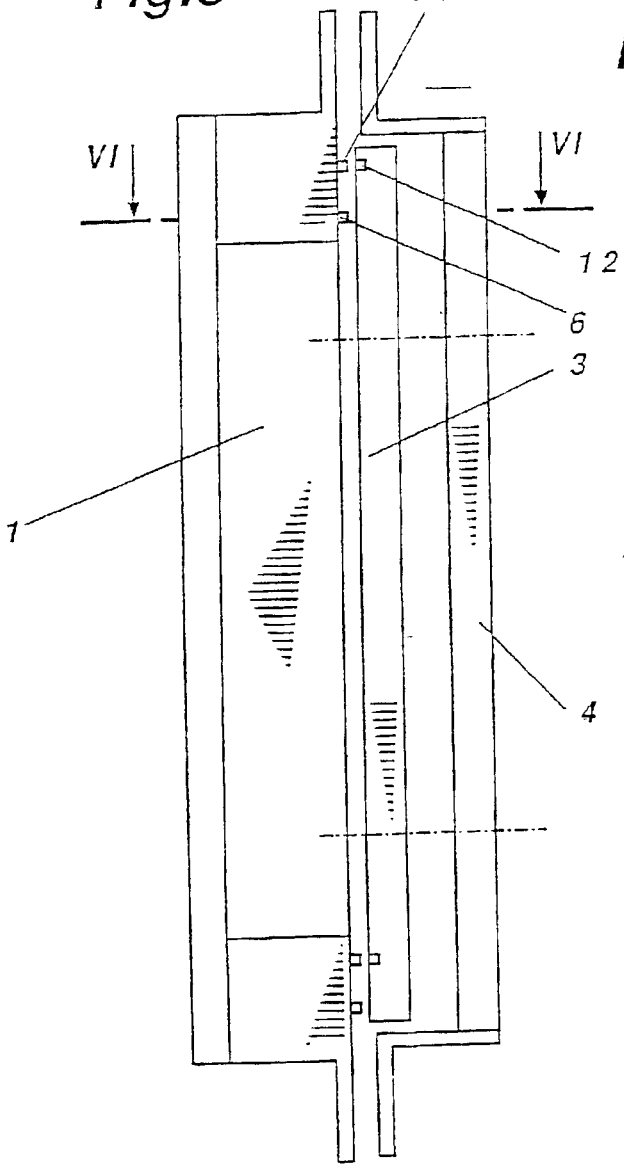
FIG. 5 is a front view of a lock according to the invention, the electromagnet is not energized.

The protuberance 6 extends from one edge 7 to the proximity of the other edge 8 of the part 1. The height of protuberance 6 is less than the distance separating the two parts 1 and 2 when the electromagnet is not energized, as seen in FIG. 5.

The armature 3 has, on its front surface, at least one housing 9, alternatively referred to herein as chamber 9, opening out on its edge 10 and capable of coinciding with the protuberance 6 when the two parts of the lock are facing each other.

For purposes of ease of discussion of the FIGS. 6A through 6D and not by way of limitation, the embodiment will be described as if the part 1 is affixed to the door frame of the opening and that the part 2 is affixed to the door.

Figure 6A:
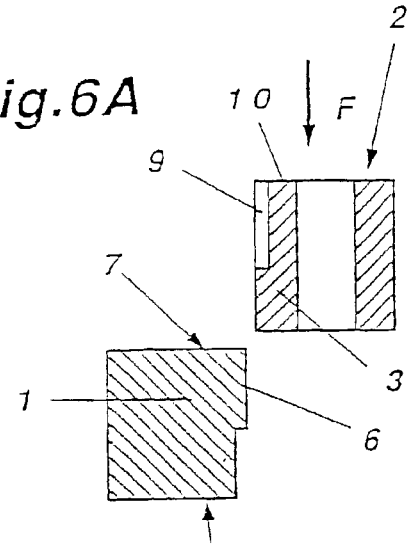
FIGS. 6A, 6B, 6C and 6D are cross-sectional views taken along the line VI—VI of FIG. 5.
Figure 6B:
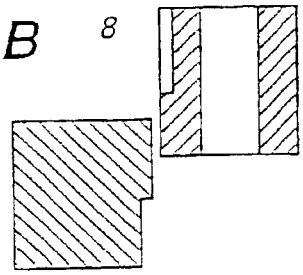
Figure 6C:
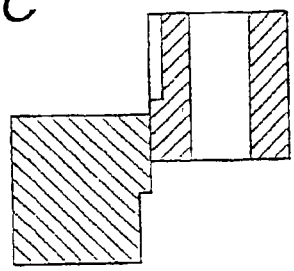
Figure 6D:
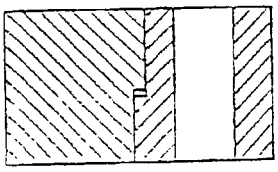

FIG.6A shows the relationship between part 1 and part 2 at the end of closing. The part 2 is displaced substantially along the arrow F and the electromagnet is energized. The part 2 passes without difficulty from the position shown in FIG. 6A to the one shown in FIG. 6B since the common springs for returning the armature are calibrated such that the action of the electromagnet has no effect on the armature 4 as long as the latter does not have a certain surface facing the electromagnet.

As the part 2 continues to move along the arrow F, the force of the electromagnet eventually becomes greater than that of the return springs, so that the armature 3 is displaced transversely and comes into contact with and is supported against the protuberance 6 (FIG. 6C) on which the armature slides until the moment when the housing 9 directly opposes the protuberance 6. The armature is drawn into the chamber 9 and so executes a new transverse displacement to occupy the position shown in FIG. 6D.

As long as the electromagnet is energized, a displacement in the opposite direction from the arrow F is impossible by virtue of the mechanical force of the engaged protuberance 6 and chamber 9.

In the case of swinging doors, it is necessary to prevent the displacement of the door in the direction of the arrow F as well as in the opposite direction.

According to the invention, such a result is obtained by providing a protuberance 11 on the part 1, similar to the protuberance 6 but extending from the edge 8 to the proximity of the edge 7, capable of cooperating with a housing 12 similar to the housing 9.

What is claimed is:

1. An electromagnetic lock comprising:

an electromagnet;

a mobile armature;

at least one return mechanism adapted to move said mobile armature towards a retracted position;

said at least one return mechanism and said mobile armature being positioned to permit displacement of said mobile armature in a direction counter to a direction of force of the at least one return mechanism wherein the retracted position of said mobile armature permits opening of the lock when said electromagnet is not energized;

each of said electromagnet and said mobile armature having at least one surface which, when said electromagnet is energized, forms first and second opposing surfaces;

said at least one return mechanism being arranged between said mobile armature and a surface supporting said mobile armature and ensuring that said first and second opposing surfaces are spaced apart from one another when said electromagnet is not energized, whereby said mobile armature is arranged between said at least one return mechanism and said electromagnet;

said first opposing surface comprising a protuberance which extends away from the first opposing surface;

said second opposing surface comprising an open chamber for closely receiving said protuberance, wherein the open chamber extends into the second opposing surface; and said first and second opposing surfaces being capable of being brought into contiguous proximity with each other when said protuberance is received in said open chamber, wherein said protuberance extends from an edge of the first opposing surface and has a height less than a distance normally separating said first and second opposing surfaces when said electromagnet is not energized.

2. The electromagnetic lock according to claim 1, wherein said at least one return mechanism comprises a spring.

3. The electromagnetic lock according to claim 1 wherein said at least one return mechanism is calibrated such that the force that tends to displace said mobile armature is greater than the force of said at least one return mechanism only when said second opposing surface of said mobile armature facing said first opposing surface of said electromagnet exceeds a certain value.

4. The electromagnetic lock according to claim 1, further comprising at least a second protuberance and at least a second open chamber for closely receiving said second protuberance.

5. The electromagnetic lock according to claim 1, wherein said second opposing surface has an edge, and wherein said open chamber extends from said edge of said second opposing surface.

6. An electromagnetic lock comprising:

an electromagnet;

a mobile armature;

each of said electromagnet and said mobile armature having at least one surface which form first and second opposing surfaces:

at least one return spring biasing said mobile armature towards a retracted position;

said at least one return spring and said mobile armature being positioned to permit displacement of said mobile armature in a direction counter to a direction of force of said at least one return spring wherein the retracted position of said mobile armature permits opening of the lock when said electromagnet is not energized;

said at least one return spring being calibrated such that the force that tends to displace said mobile armature is greater than the force of said at least one return spring maintaining said mobile armature in the retracted position;

said at least one return spring extending from a surface of said mobile armature that faces opposite from the first opposing surface of said mobile armature and ensuring that said first and second opposing surfaces are spaced apart from one another when said electromagnet is not energized;

said first opposing surface comprising a protuberance which extends from an edge of the first opposing surface to at least partially across the first opposing surface, wherein the protuberance extends away from the first opposing surface; and said second opposing surface comprising an open recess for closely receiving said protuberance, wherein the open recess extends into the second opposing surface, wherein when said first and second opposing surfaces are brought into contiguous proximity with each other said protuberance is received in said open recess, and wherein said protuberance has a height which is less than a distance normally separating said first and second opposing surfaces when the electromagnet is not energized.

7. The electromagnetic lock according to claim 6, wherein said first opposing surface comprises at least a second protuberance and wherein said second opposing surface comprises at least a second open recess for closely receiving said second protuberance.

8. The electromagnetic lock according to claim 6, wherein said second opposing surface has an edge, wherein said open recess extends from said edge of said second opposing surface, and wherein said first and second opposing surfaces are capable of being arranged in contiguous alignment when the electromagnet is energized.

9. A method of locking a first element to a second element, the method comprising:

providing an electromagnetic lock comprising an electromagnet, a mobile armature and a return mechanism;

arranging the electromagnet on the first element;

arranging the mobile armature and the return mechanism on the second element;

positioning the return mechanism and the mobile armature in a manner to permit displacement of the mobile armature in a direction counter to the direction of force of the return mechanism to define a retracted position of the mobile armature to permit opening of the lock when the electromagnet is not energized;

providing a protuberance on a first opposing surface of the electromagnet, the protuberance extending laterally from an edge of the first opposing surface and away from the first opposing surface; and providing an open chamber in a second opposing surface of the mobile armature for closely receiving said protuberance, wherein the open chamber extends into the second opposing surface;

wherein the return mechanism extends from a surface of the mobile armature that faces opposite from the second opposing surface of the mobile armature, wherein when the first and second opposing surfaces are arranged to be in contiguous proximity with each other and when the electromagnet is energized, the protuberance is received in the open chamber, and wherein when the first and second opposing surfaces are arranged to be in contiguous proximity with each other and when the electromagnet is thereafter not energized, the return mechanism moves the mobile armature away from the electromagnet and towards the retracted position, whereby the protuberance is caused to move out of the open chamber and whereby the first and second opposing surfaces are spaced apart from one another.

10. The method according to claim 9, further comprising:

allowing the mobile armature to engage the protuberance before the protuberance is received in the open chamber and before the first and second opposing surfaces are in contiguous alignment.

11. The method according to claim 9, further comprising:

allowing the second opposing surface of the mobile armature to engage the protuberance before the protuberance is received in the open chamber and before the first and second opposing surfaces are in contiguous alignment.

12. The method according to claim 9, wherein the first and second elements comprise a door arrangement.

13. An electromagnetic lock having a locked position and an unlocked position and comprising:

an electromagnet comprising a first side, a second side, and a front surface arranged between the first and second sides;

the front surface of the electromagnet comprising a length and a width;

at least one protuberance arranged on and extending away from the front surface of the electromagnet;

the at least one protuberance extending from the first side along a direction of the width and towards the second side;

a mobile member coupled to at least one return spring;

the mobile member comprising a first side, a second side, a front surface arranged between the first and second sides;

the at least one return spring extending from a surface of the mobile member that faces in a direction that is opposite from the front surface;

the front surface of the mobile member comprising a length and a width;

at least one recess arranged on and extending into the front surface of the mobile member;

the at least one recess extending from the first side along a direction of the width and towards the second side;

the at least one protuberance being capable of penetrating into the at least one recess when the electromagnet is energized; and the at least one return spring biasing the mobile member away from the electromagnet and towards a retracted position when the electromagnet is not energized, wherein, in the unlocked position, the electromagnet is not energized, the at least one protuberance is arranged outside the at least one recess, and the front surfaces of the mobile member and the electromagnet are spaced apart from one another, and wherein, in the locked position, the electromagnet is energized, the at least one protuberance penetrates the at least one recess, and the front surfaces of the mobile member and the electromagnet contact one another.

14. The electromagnetic lock according to claim 13, wherein the at least one return spring comprises two return springs.

15. The electromagnetic lock according to claim 13, wherein the at least one return spring applies a biasing force to the mobile member that is less than a force that tends to displace the mobile member towards the electromagnet when the electromagnet is energized.

16. The electromagnetic lock according to claim 13, wherein the at least one protuberance comprises first and second protuberances, wherein the first protuberance extends from the first side along a direction of the width and towards the second side, and wherein the second protuberance extends from the second side along a direction of the width and towards the first side.

17. The electromagnetic lock according to claim 16, wherein the at least one recess comprises first and second recesses, wherein the first recess extends from the first side along a direction of the width and towards the second side, wherein the second recess extends from the second side along a direction of the width and towards the first side, and wherein the first and second protuberances are capable of penetrating into the first and second recesses when the electromagnet is energized.

18. The electromagnetic lock according to claim 13, wherein the at least one protuberance extends from the first side along a direction of the width to a proximity of the second side.

19. The electromagnetic lock according to claim 13, wherein the at least one recess extends from the first side along a direction of the width to a proximity of the second side.

20. The electromagnetic lock according to claim 13, wherein the mobile member comprises a mobile armature.

21. The electromagnetic lock according to claim 13, wherein a height of the at least one protuberance is less than a distance normally separating said front surfaces of the mobile member and the electromagnet when the electromagnet is not energized.

22. The electromagnetic lock according to claim 13, wherein each of the at least one protuberance and the at least one recess comprises a length and a width which is less than the length.

23. The electromagnetic lock according to claim 13, wherein the at least one protuberance comprises first and second protuberances, the first protuberance extending from the first side along a direction of the width and towards the second side, the second protuberance extending from the second side along a direction of the width and towards the first side, wherein the at least one recess comprises first and second recesses, the first recess extending from the first side along a direction of the width and towards the second side, the second recess extending from the second side along a direction of the width and towards the first side, and wherein the first and second protuberances are capable of penetrating into the first and second recesses when the electromagnet is energized.

24. A method of locking a first element to a second element using the electromagnetic lock of claim 13, method comprising:

arranging the electromagnet on the first element;

arranging the mobile member on the second element;

moving the second element towards the first element;

moving the front surface of the mobile member into contact with the at least one protuberance;

moving the second element relative to the first element until the front surface of the mobile member is aligned with the front surface of the electromagnet; and locking the first and second elements together by moving the mobile member towards the electromagnet, whereby the locking occurs when the at least one protuberance penetrates into the at least one recess of the mobile member.

25. A method of locking a first element to a second element using the electromagnetic lock of claim 13, the method comprising:

arranging the electromagnet on the first element;

arranging the mobile member on the second element;

moving the second element towards the first element;

moving the mobile member towards the electromagnet against a biasing force of the of the at least one return spring;

moving the second element relative to the first element until the mobile member is aligned with the electromagnet; and locking the first and second elements together by further moving the mobile member towards the electromagnet, whereby locking occurs when the at least one protuberance penetrates into the at least one recess and the electromagnet is energized.

26. A method of locking a first element to a second element using the electromagnetic lock of claim 1, the method comprising:

arranging the electromagnet on the first element;

arranging the mobile armature on the second element;

moving the second element towards the first element;

moving the mobile armature away from the retracted position and towards the electromagnet against a biasing force of the of the at least one return mechanism;

moving the second element relative to the first element until the mobile armature is aligned with the electromagnet; and locking the first and second elements together by further moving the mobile armature towards the electromagnet, whereby locking occurs when the protuberance penetrates into the open chamber and the electromagnet is energized.

27. A method of locking a first element to a second element using the electromagnetic lock of claim 6, the method comprising:

arranging the electromagnet on the first element;

arranging the mobile armature on the second element;

moving the second element towards the first element;

moving the mobile armature away from the retracted position and towards the electromagnet against a biasing force of the return spring;

moving the second element relative to the first element until the mobile armature is aligned with the electromagnet; and locking the first and second elements together by further moving the mobile armature towards the electromagnet, whereby locking occurs when the protuberance penetrates into the open recess and the electromagnet is energized.

* * * * *